US011233330B2

(12) United States Patent
Clauzier et al.

(10) Patent No.: US 11,233,330 B2
(45) Date of Patent: Jan. 25, 2022

(54) MONOPOLE WIRE-PLATE ANTENNA FOR DIFFERENTIAL CONNECTION

(71) Applicant: Commissariat a l'energie atomique et aux energies alternatives, Paris (FR)

(72) Inventors: Olivier Clauzier, Grenoble (FR); Serge Bories, Grenoble (FR); Christophe Delaveaud, Grenoble (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 81 days.

(21) Appl. No.: 16/723,204

(22) Filed: Dec. 20, 2019

(65) Prior Publication Data

US 2020/0365994 A1 Nov. 19, 2020

(30) Foreign Application Priority Data

Dec. 21, 2018 (FR) ..... 18 73957

(51) Int. Cl.

| | |
|---|---|
| ***H01Q 9/30*** | (2006.01) |
| ***H01Q 9/16*** | (2006.01) |
| ***H01Q 19/13*** | (2006.01) |

(52) U.S. Cl.

CPC ..... *H01Q 9/30* (2013.01); *H01Q 9/16* (2013.01); *H01Q 19/138* (2013.01)

(58) Field of Classification Search

CPC ..... H01Q 9/30; H01Q 9/16; H01Q 9/0457; H01Q 9/045; H01Q 9/0421; H01Q 19/138

See application file for complete search history.

(56) References Cited

U.S. PATENT DOCUMENTS 6,750,825 B1 6/2004 Delaveaud et al.

FOREIGN PATENT DOCUMENTS

| | | | | |
|---|---|---|---|---|
| AU | WO 2006/135956 A1 * | 12/2006 | ..... | H01Q 9/0407 |
| FR | 2 709 878 A1 | 3/1995 | | |
| WO | WO 2006/135956 A1 | 12/2006 | | |

OTHER PUBLICATIONS

French Preliminary Search Report dated Sep. 26, 2019 in French Application 18 73957 filed Dec. 21, 2018 (with English Translation of Categories of Cited Documents & Written Opinion), 10 pages.

Deng, J-Y. et al., "Broadband Patch Antennas Fed by Novel Tuned Loop," IEEE Transactions on Antennas and Propagation, vol. 61, No. 4, Apr. 2013, 4 pages.

Petosa, A. et al., "Suppression of unwanted probe radiation in wideband probe-fed microstrip patches," Electronics Letters, vol. 35, No. 5, Mar. 4, 1999, 3 pages.

Foster, P. R. et al., "A Wideband Balun From Coaxial Line to TEM Line," Antennas and Propagation, Conference Publication No. 407, Apr. 4-7, 1995, 5 pages.

(Continued)

*Primary Examiner* — Seokjin Kim

(74) *Attorney, Agent, or Firm* — Oblon, McClelland, Maier & Neustadt, L.L.P.

(57) ABSTRACT

The monopole wire-plate antenna includes a ground plane, a roof arranged at a distance from the ground plane and at least one electrically conductive element electrically linking the ground plane to the roof. The antenna includes a supply loop arranged substantially orthogonally with respect to the ground plane, the supply loop being open such that it has two opposing longitudinal ends arranged so as to be linked to a differential connection.

15 Claims, 7 Drawing Sheets

(56) References Cited

OTHER PUBLICATIONS

Delaveaud, C. et al., "New kind of microstrip antenna: the monopolar wire-patch antenna," Electronics Letters, vol. 30, No. 1, Jan. 6, 1994, 2 pages.
Jung, J-H.et al., "Electromagnetically Coupled Small Broadband Monopole Antenna," IEEE Antennas and Wireless Propagation Letters, vol. 2, 2003, 3 pages.

* cited by examiner

MONOPOLE WIRE-PLATE ANTENNA FOR DIFFERENTIAL CONNECTION

TECHNICAL FIELD OF THE INVENTION

The technical field of the invention relates to monopole wire-plate antennas. More particularly, the invention relates to a monopole wire-plate antenna comprising a ground plane, a roof arranged at a distance from the ground plane, and at least one electrically conductive element electrically linking the ground plane to the roof.

STATE OF THE ART

The article "New kind of microstrip antenna: the monopolar wire-patch antenna" by Ch. Delaveaud et al., published in ELECTRONICS LETTERS on 6 Jan. 1994 vol. 30, No. 1 pages 1 and 2, defines an example of monopole wire-plate antenna. As illustrated in FIG. 1, a monopole wire-plate antenna 100, of the type of this article by Ch. Delaveaud et al., comprises a ground plane 101, a planar electrically conductive element 102, called roof, one or more electrically conductive elements 103*a*, 103*b*, called ground wire(s), connecting the roof 102 to the ground plane 101 and possibly a dielectric substrate 104 on which the roof 102 can be printed. In addition to the ground wires 103*a*, 103*b* linking the roof 102 to the ground plane 101, the antenna 100 comprises a coaxial supply probe 105 having a central core 106*a* passing through the ground plane 101, without electrical contact therewith, and extending to the roof 102 so as to establish an electrical connection therewith. The core 106*a* is, moreover, successively surrounded by a sheath 106*b* made of dielectric material 106*b*, then a metal tube 106*c* electrically linked to the ground plane, the sheath 106*b* made of dielectric material ensuring the electrical insulation between the core 106*a* and the metal tube 106*c*. Such a coaxial supply probe 105 forms a coaxial waveguide in which a quasi transverse electromagnetic mode (TEM) is established to guide and propagate the wave in the waveguide. This type of antenna 100 makes it possible to emit an electromagnetic field, also called electromagnetic wave, with a high efficiency for frequencies situated below the conventional cavity resonance modes $TM_{nm}$ (for "Transverse Magnetic" of indices n and m) for this antenna geometry. Conventional cavity resonance is understood to mean the particular distribution of an electromagnetic field deriving from the solving of the Maxwell equations with boundary conditions imposed by the topology of the antenna. Conventionally, this monopole wire-plate antenna can be supplied asymmetrically from a suitable radiofrequency transmitter having an asymmetrical connection (for example a microstrip line or a coaxial connector).

Such an antenna 100 offers the advantage of having a compact design, so it is therefore perfectly suitable for association with components deriving from microelectronics, notably within a mobile device. One drawback linked to this type of antenna is that its technological integration in a small volume can require the radiofrequency transmitter connected to the antenna to have a differential connection instead of being asymmetrical. The transmitter with a differential connection makes it possible to generate two signals of equal amplitude and in phase opposition: the transmitter then forms a so-called "balanced" supply source of the antenna. Now, because of the use of the coaxial supply probe 105, it is necessary to transform the balanced supply into an unbalanced supply to supply the monopole wire-plate antenna by using this coaxial supply probe 105. In this sense, it is conventional practice to associate the transmitter with a differential connection with a balun, also called balun transformer, to make the transition between a symmetrical waveguide structure connected to the radiofrequency transmitter and an asymmetrical topology which is the coaxial probe 105. In other words, the balun makes it possible to adapt the differential connection of the radiofrequency transmitter to be compatible with the supply coaxial probe. The balun, well known to the person skilled in the art, derives from the words BALanced and UNbalanced. One drawback with this adaptation of the differential connection is that it increases the size of the radiofrequency front-ends, involving the addition of extra components to be assembled that can generally not be integrated on a chip, resulting in radiofrequency losses. In this respect, there is a need to develop a solution that makes it possible to supply an antenna with roof, notably capacitive, and with ground plane that are electrically linked to one another without resorting to the use of a balun when the antenna is intended to be linked to a transmitter with differential connection.

The patent application FR2709878 discloses a monopole wire-plate antenna comprising a ground plane, a first radiating element in the form of a capacitive roof, and a second radiating element in the form of a conductive wire linking the capacitive roof to the ground plane. This antenna also comprises a cable, or coaxial supply probe, the central core of which is connected to the capacitive roof. However, if the supply source of the coaxial supply probe is a radiofrequency transmitter with a differential connection, that here still requires the use of a balun.

The document "Electromagnetically Coupled Small Broadband Monopole Antenna" by Jong-Ho Jung and Ikmo Park published in IEEE ANTENNAS AND WIRELESS PROPAGATION LETTERS, Vol. 2, 2003, in pages 349 to 351 describes a monopole wire-plate antenna whose roof is coupled to a spiral situated in a plane at a distance from the roof and parallel to the roof. The spiral is connected to a coaxial supply probe. The spiral associated with the coaxial supply probe makes it possible to excite the antenna. However, if the radiofrequency transmitter has a differential connection, that here still requires the use of a balun.

The document "A WIDEBAND BALUN FROM COAXIAL LINE TO TEM LINE" by P R Foster and Soe Min Tun published in Antennas and Propagation, 4-7 Apr. 1995 Conference Publication No. 407, © IEE 1955 notably describes the operation of a balun.

OBJECT OF THE INVENTION

The aim of the invention is to allow a monopole wire-plate antenna to be supplied without requiring the presence of a balun.

For this purpose, the invention relates to a monopole wire-plate antenna comprising a ground plane, a roof arranged at a distance from the ground plane, at least one electrically conductive element electrically linking the ground plane to the roof, this antenna being characterized in that it comprises a supply loop arranged substantially orthogonally with respect to the ground plane, said supply loop being open such that it comprises two opposing longitudinal ends arranged so as to be linked to a differential connection.

Thus, with such a supply loop it is possible to link the antenna to a transmitter with differential connection without having to make an adaptation of the differential connection via a balun between the transmitter and the supply loop. The supply loop makes it possible, in the operation of the monopole wire-plate antenna supplied by the transmitter with differential connection when emitting a signal or by an electromagnetic wave being propagated in the environment of the antenna upon the reception of a signal, to impose a distribution of the electromagnetic field in an appropriate manner between the ground plane and the roof to allow the monopole wire-plate antenna to have a desired impedance and, if appropriate, to emit a satisfactory electromagnetic wave. Moreover, the supply/excitation of the antenna by the supply loop makes it possible to obtain a symmetrical system, resulting in the reduction of the propagation of the electrical currents on the ground plane of the antenna, thus limiting the influence of the close environment of the antenna, such as, for example, the influence of a hand of a person holding a device equipped with the antenna.

The monopole wire-plate antenna can comprise one or more of the following features:

the antenna comprises a balanced waveguide, the balanced waveguide comprising a first electrical conductor and a second electrical conductor, the first electrical conductor being connected to one of the longitudinal ends of the supply loop and the second electrical conductor being connected to the other of the longitudinal ends of the supply loop;

the supply loop comprises a first part distal to the ground plane, a second part proximal to the ground plane, a third part linking the first and second parts, the longitudinal ends being arranged opposite the third part;

the supply loop comprises a fourth part comprising: a first portion extending from the first part of the supply loop, this first portion comprising one of the longitudinal ends of the supply loop; and a second portion extending from the second part of the supply loop, this second portion comprising the other of the longitudinal ends of the supply loop;

the supply loop comprises a fourth part extending from the first part and comprising one of the longitudinal ends of the supply loop, the second part comprising the other of the longitudinal ends of the supply loop;

the supply loop comprises a fourth part extending from the second part and comprising one of the longitudinal ends of the supply loop, the first part comprising the other of the longitudinal ends of the supply loop;

a part of the supply loop is formed by a portion of the roof, or the supply loop is situated at a distance from the roof, or the supply loop is in contact with the roof;

said supply loop has, in the operation of the antenna, two regions of excitation of the antenna in which the currents are in phase and circulate substantially orthogonally with respect to the ground plane;

said antenna is a wide-bandwidth antenna for which the supply loop has a length, between its two opposing longitudinal ends, of between $\lambda_g/3$ and $\lambda_g/1.6$ with $\lambda_g$ being the operating wavelength of the antenna; and said antenna is a narrowband antenna for which the supply loop has a length, between its two opposing longitudinal ends, of between $\lambda_g/3.5$ and $\lambda_g/3.7$ with $\lambda_g$ the operating wavelength of the antenna.

The invention also relates to a radiofrequency device comprising a monopole wire-plate antenna as described and a radiofrequency transmitter with differential connection linked to the supply loop.

Preferably, the differential connection of the radiofrequency transmitter comprises first and second connection terminals, the antenna comprises a balanced waveguide, the balanced waveguide comprising first and second electrical conductors, the first electrical conductor is connected, on the one hand, to one of the longitudinal ends of the supply loop and, on the other hand, to the first connection terminal, and the second electrical conductor is connected, on the one hand, to the other of the longitudinal ends of the supply loop and, on the other hand, to the second connection terminal.

BRIEF DESCRIPTION OF THE DRAWINGS

The invention will be better understood on reading the following detailed description of particular embodiments, given purely by way of nonlimiting example and made with reference to the attached drawings listed hereinbelow.

In these figures, the same references are used to denote the same elements.

Figure 1:
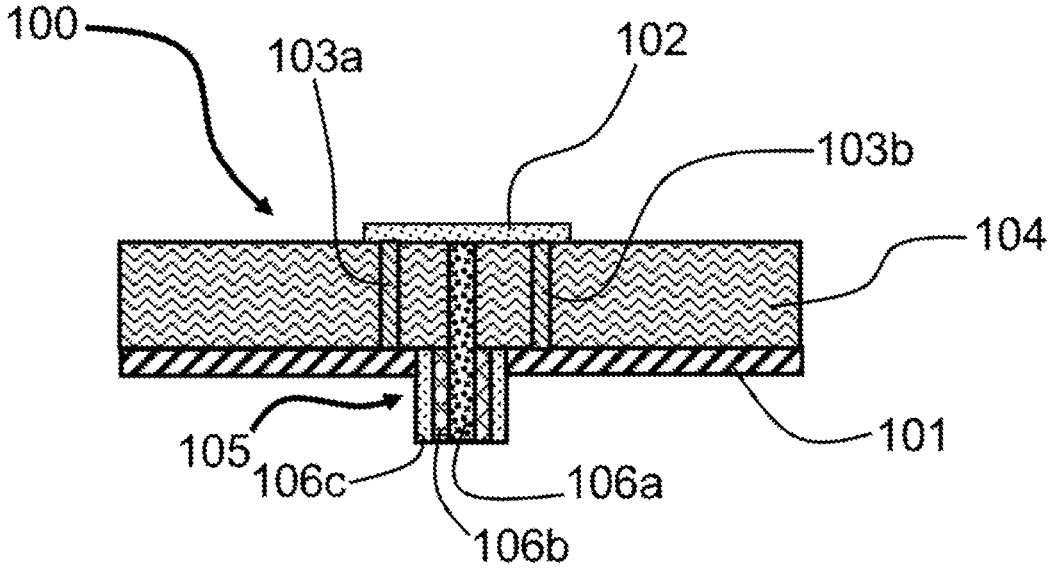
Fig. 1 (prior art)
FIG. 1 represents, in cross-section, a monopole wire-plate antenna according to the prior art.

Moreover, the elements represented in these figures are not necessarily represented according to a uniform scale to make the figures more legible.

DETAILED DESCRIPTION

Hereinbelow, a reference frame of orthogonal axes XYZ represented in FIGS. 2 to 12 is defined. Notably, the terms "under", and "bottom" with respect to the elements represented in these FIGS. 2 to 12 are interpreted according to the orientation given by the axis Z. This reference frame is that of the frame of reference of a monopole wire-plate antenna as described hereinbelow. A dimension given according to an axis of this frame is a dimension measured parallel to this axis.

In the following, the operating frequency of the monopole wire-plate antenna corresponds to the frequency at which the monopole wire-plate antenna emits, or receives, an electromagnetic wave, notably a radio wave, also called, if appropriate, signal emitted or signal received/picked up. More generally, in speaking of this electromagnetic wave, reference is made to the electromagnetic wave to be processed (whether that be in reception or in emission) at the operating frequency of the monopole wire-plate antenna. In other words, the monopole wire-plate antenna is configured to emit and/or receive a corresponding electromagnetic wave.

Moreover, an operating wavelength of the antenna, denoted $\lambda_0$ at the operating frequency of the antenna, corresponds to the spatial period of the electromagnetic wave to be processed by the antenna being propagated in vacuum or in air when the monopole wire-plate antenna comprises such a propagation medium. $\lambda_0$ is associated with the propagation of the electromagnetic wave in vacuum or in air. The propagation medium of the monopole wire-plate antenna corresponds to a medium of emission and/or of reception of the electromagnetic wave to be processed. Thus, the propagation medium is, if appropriate, the medium from which the antenna picks up the electromagnetic wave to be processed or to which the antenna emits the electromagnetic wave to be processed. More generally, it is said that the electromagnetic wave to be processed is propagated in a propagation medium of the monopole wire-plate antenna (for example air, vacuum, a dielectric material, etc.) in contact with one or more radiating parts of the antenna, and the operating wavelength of the antenna (that is to say the wavelength associated with the propagation of the electromagnetic wave to be processed at the operating frequency of the antenna) is then denoted $\lambda_g$: the term guided wavelength is also used. In the following, when the monopole wire-plate antenna is said to be supplied/excited, it is so at the operating wavelength of the antenna.

The monopole wire-plate antenna is said to be impedance matched when it has a reflection coefficient strictly less than a given level (typically −9.54 dB for communication terminals, and −15 dB for example for base stations).

As illustrated according to different embodiments in FIGS. 2 to 5, the invention relates to a monopole wire-plate antenna 100, also simply called antenna 100, comprising a ground plane 101 (notably planar), a roof 102 (notably planar) arranged at a distance from the ground plane 101, and at least one electrically conductive element 103*a*, 103*b* electrically linking the ground plane 101 to the roof 102. In FIGS. 2 to 5, two electrically conductive elements 103*a*, 103*b* are represented by way of example: the number of these electrically conductive elements 103*a*, 103*b* can be higher. Each electrically conductive element 103*a*, 103*b* electrically linking the ground plane 101 to the roof 102 is also called short-circuit element between the roof 102 and the ground plane 101, or ground wire. Each electrically conductive element 103*a*, 103*b* notably forms a radiating part of the antenna 100. The roof 102 is electrically conductive, and is also called electrically conductive planar element, or electrically conductive plate. The ground plane 101 is electrically conductive and preferentially adopts a planar form. The ground plane 101, the roof 102 and each electrically conductive element 103*a*, 103*b* can each be, in a nonlimiting manner, made of copper, of aluminium or of steel. Moreover, this antenna 100 comprises a supply loop 107, notably called "antenna 100 supply loop".

Figure 6:
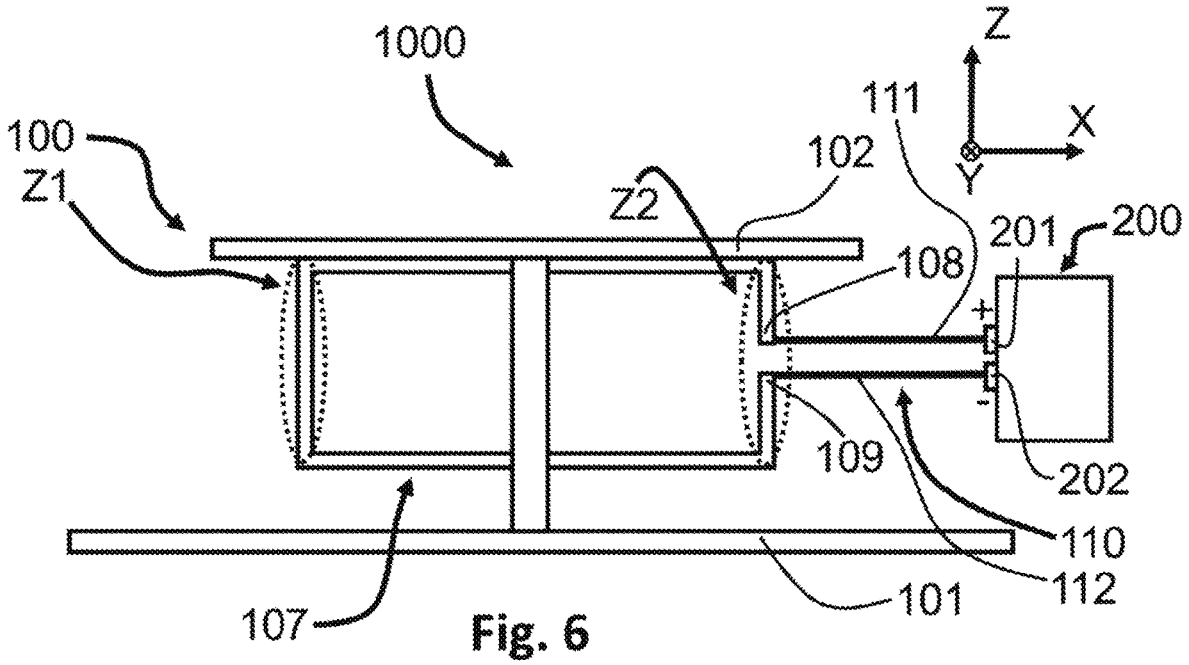
FIG. 6 illustrates a side view of a radiofrequency device comprising a monopole wire-plate antenna of the type of FIG. 2.
Figure 7:
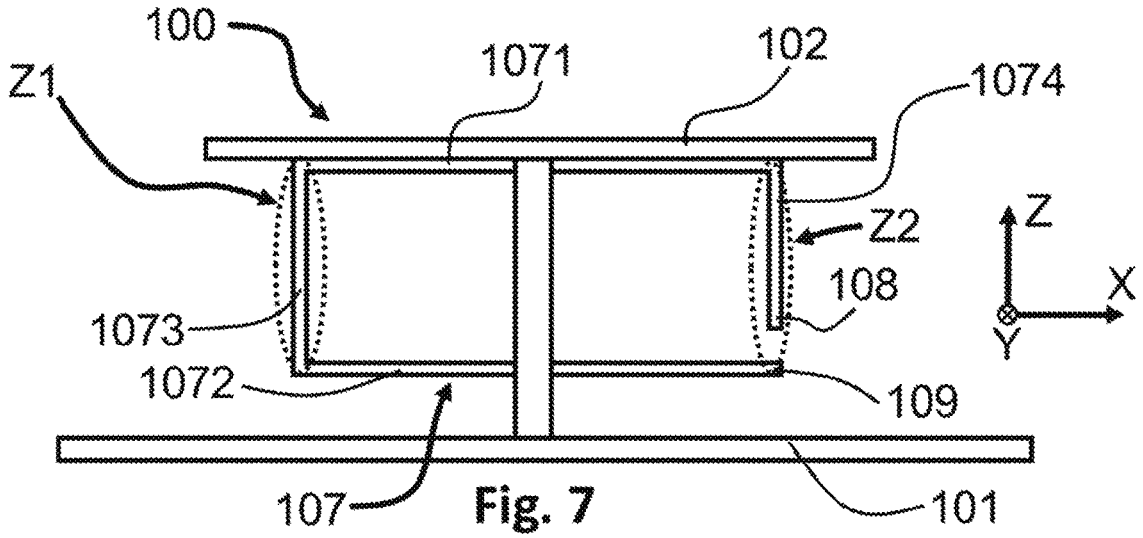
FIG. 7 illustrates a side view of a particular embodiment of a monopole wire-plate antenna of the type of FIG. 2.
Figure 8:
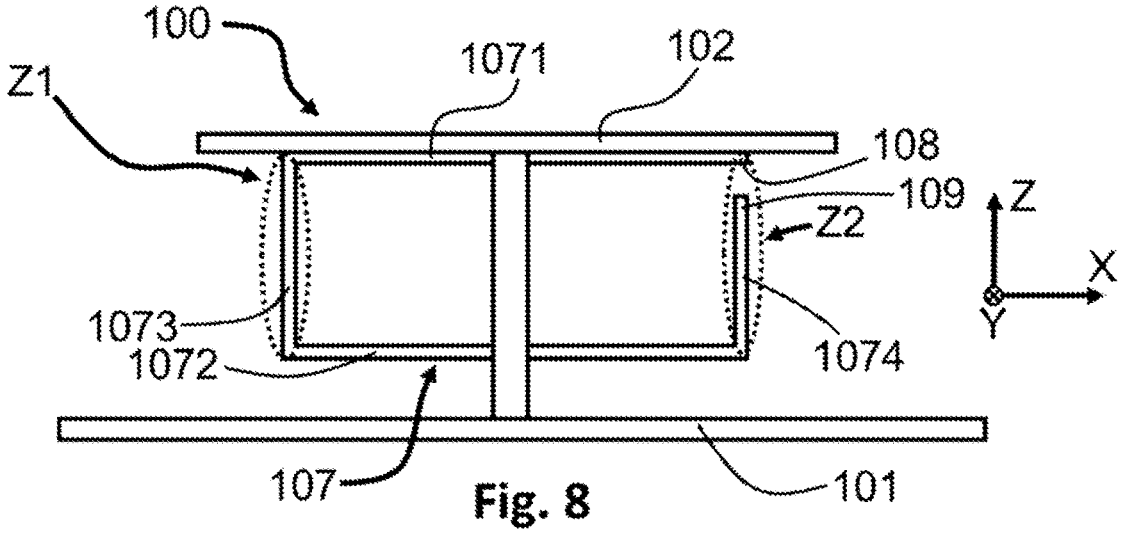
FIG. 8 illustrates a side view of a particular embodiment of a monopole wire-plate antenna of the type of FIG. 2.

The supply loop 107 is, open such that it comprises two opposing longitudinal ends 108, 109 arranged so as to be linked to a differential connection. The differential connection is notably that of a radiofrequency transmitter 200 (FIG. 6). The supply loop 107 is arranged substantially orthogonally with respect to the ground plane 101. Thanks to this supply loop 107, there is no longer a need to use a balun or other circuit carrying out an asymmetrical line to symmetrical line transformation (or vice versa) between the radiofrequency transmitter and the antenna 100.

"Two opposing longitudinal ends 108, 109 of the supply loop 107 and arranged so as to be linked to a differential connection" is preferentially understood to mean that the supply loop 107 can be directly linked to terminals 201, 202 of the transmitter 200 (FIG. 6), or via a differential waveguide 110 as will be described hereinbelow.

When the antenna 100 is used to emit a signal, the electromagnetic wave generated by the radiofrequency transmitter can supply the antenna 100 via this supply loop 107 arranged under the roof 102 in order to emit this electromagnetic wave as signal.

When the antenna 100 is used to receive a signal, the antenna 100 picks up the signal (the electromagnetic wave) from the free space, this signal supplying the supply loop 107 of the antenna 100 in an appropriate manner for this signal to be transmitted to the radiofrequency transmitter.

The supply loop 107 can be arranged between the roof 102 and the ground plane 101. This offers the advantage of a satisfactory integration, and the advantage of reducing the overall size of the antenna 100 by incorporating the supply loop 107 in a separation space between the roof 102 and the ground plane 101.

Such a supply loop 107 is notably arranged such that, when the antenna 100 is supplied by the radiofrequency transmitter 200 or by the signal picked up by the antenna 100;

currents are induced in the supply loop 107 substantially orthogonally to the ground plane 101 and these currents are mostly and in phase in two opposing parts of the supply loop 107 extending between the ground plane 101 and the roof 102, notably substantially orthogonally to the ground plane 101.

In the present description, "substantially orthogonal" is notably understood to mean orthogonal or orthogonal to plus or minus ten degrees, Preferably, "substantially orthogonal" can be replaced by "orthogonal".

In the present description, substantially parallel is notably understood to mean parallel or parallel to plus or minus ten degrees. Preferably, "substantially parallel" can be replaced by "parallel".

"Supply loop 107 arranged substantially orthogonally with respect to the ground plane 101" is notably understood to mean that the supply loop 107 extends according to a profile that is included, or that can be projected orthogonally, in a plane substantially orthogonal to the ground plane 101. To put it another way, the profile of the supply loop 107 can run, lengthwise of the supply loop 107, within a plan substantially orthogonal to the ground plane 101. Notably, the profile of the supply loop 107 is rectangular in a plane substantially orthogonal to the ground plane 101 and notably to the roof 102. To put it yet another way, the supply loop 107 can be placed in a plane substantially orthogonal to the ground plane 101.

Figure 2:
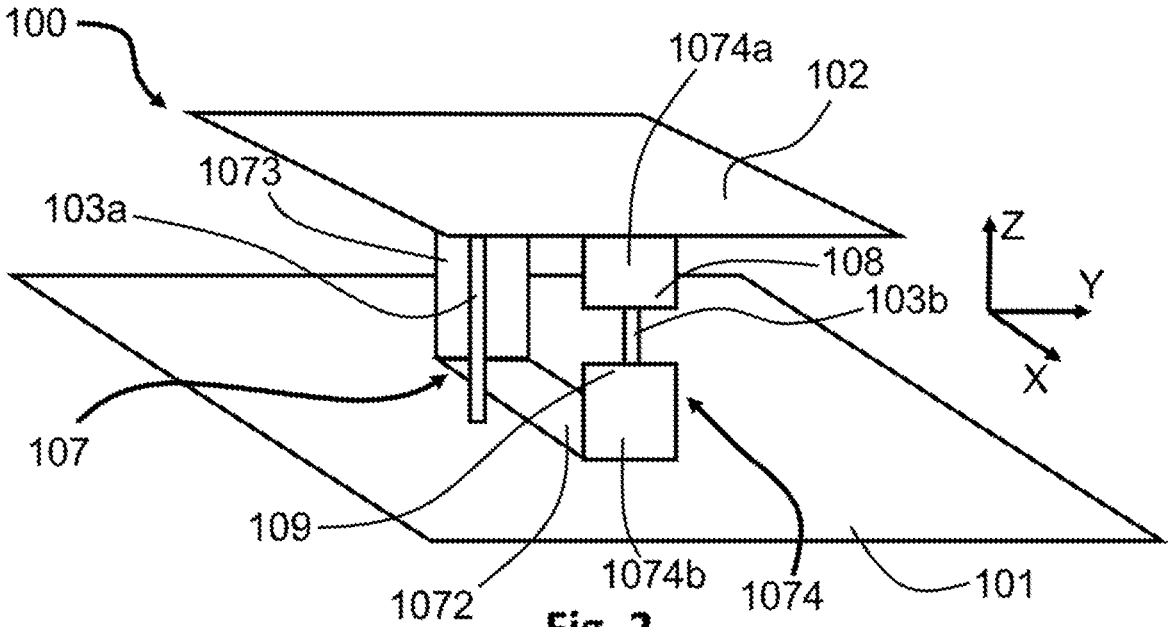
FIG. 2 illustrates a perspective view of a narrowband monopole wire-plate antenna according to an embodiment of the invention.
Figure 3:
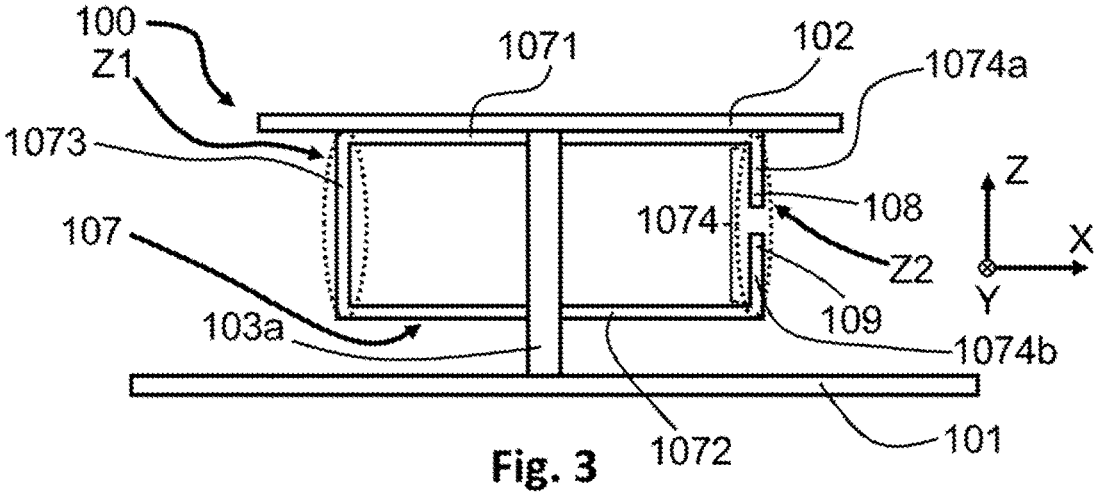
FIG. 3 is a side view of the antenna of FIG. 2.
Figure 4:
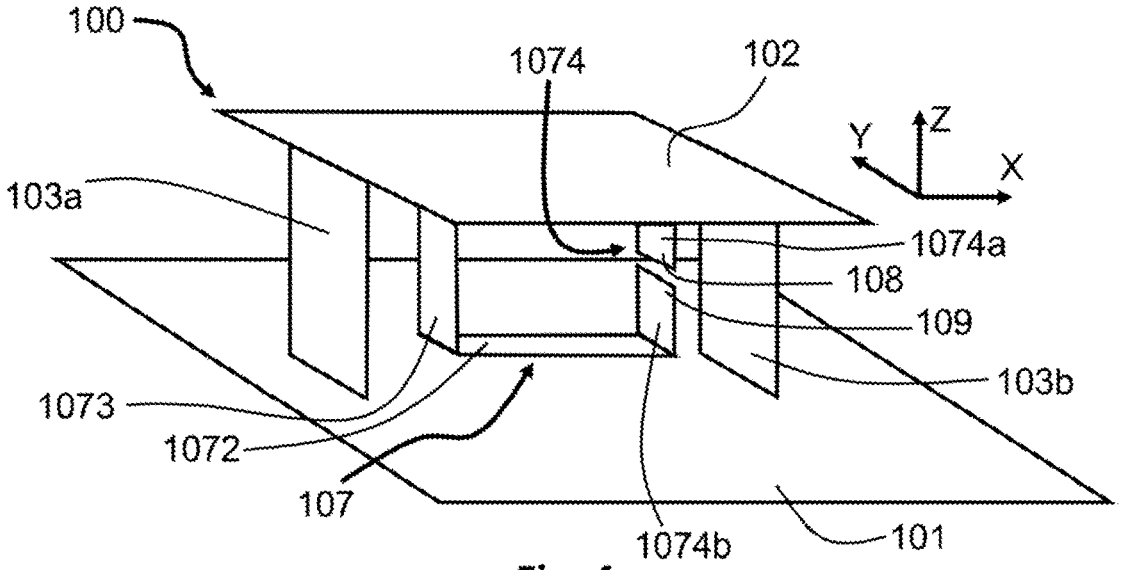
FIG. 4 illustrates a perspective view of a wideband monopole wire-plate antenna according to an embodiment of the invention.
Figure 5:
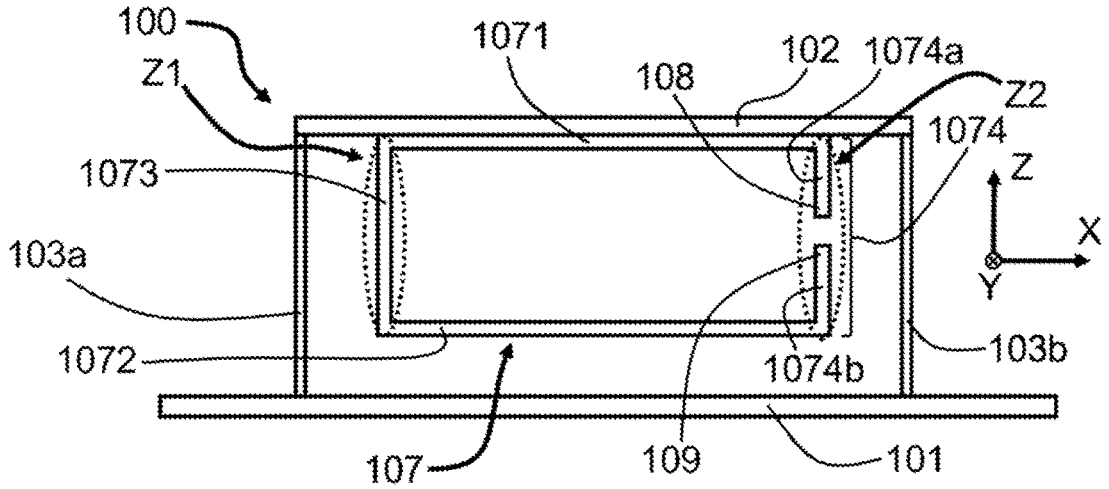
FIG. 5 is a side view of the antenna of FIG. 4.

The invention also relates to a radiofrequency device 1000, notably as illustrated by way of example in FIG. 6, comprising the antenna 100 as described and the radiofrequency transmitter 200 with differential connection linked to the supply loop 107, notably to the supply loop 107 of the antenna of the type of FIGS. 2 and 3 (as illustrated in FIG. 6) or of the antenna of the type illustrated in FIGS. 4 and 5. The radiofrequency transmitter 200 is an electronic transceiver component whose coupling to the antenna 100 (that is to say the link to the supply loop 107) makes it possible to emit or receive the corresponding electromagnetic wave, or signal, by the antenna 100. The radiofrequency transmitter can notably supply the antenna by a discrete port, for example of 50 ohms over its entire operating band. "Differential connection" of the radiofrequency transmitter 200 is understood thereby to mean that the radiofrequency transmitter 200, and more particularly this differential connection, comprises two terminals 201, 202 from which the electromagnetic wave, making it possible to supply the antenna 100 in order to emit the signal, is emitted according to a balanced mode. To generate this electromagnetic wave supplying the antenna 100 whose mode is balanced, the radiofrequency transmitter 200 can send to its two terminals 201, 202, respectively two signals of equal amplitude and in phase opposition. It is notably in this sense that the radiofrequency transmitter 200 of FIG. 6, and more particularly the differential connection, comprises a first connection terminal 201 denoted "+", and a second connection terminal 202 denoted "−". There are often antennas supplied from a source in differential mode in mobile terminals such as smartphones. The use of a differential supply whose source is the radiofrequency transmitter 200 in association with the present antenna 100 does not require the use of a balun, and can make it possible to make the structure of the antenna symmetrical. Conversely, upon reception, the signal picked up by the antenna 100 is transmitted to the differential connection of the transmitter by two signals of equal amplitude and in phase opposition generated within the supply loop 107 when it is supplied by the signal picked up by the antenna 100. Moreover, such an antenna 100 offers the advantage that the currents on its ground plane 101 are limited, thus limiting the influence of the near environment of the antenna 100 such as a hand of a person holding the smartphone comprising this antenna 100.

In order to suitably supply the monopole wire-plate antenna 100, an electromagnetic field has to be formed in accordance with the mode which is established under the roof 102. Notably, the electrical field, resulting from this electromagnetic field is oriented according to the axis Z, that is to say substantially orthogonally to the ground plane 101. This is permitted by the fact that the supply loop 107 is orthogonal with respect to the ground plane 101. In fact the supply loop 107 has parts substantially orthogonal to the ground plane 101 in which currents can be propagated.

Moreover, still in order to allow the currents to be established suitably in the supply loop 107 to make the monopole wire-plate antenna 100 operate, the supply loop 107 preferentially comprises two regions Z1, Z2 (represented in dotted lines in FIGS. 3, 5 and 6) of excitation of the antenna 100 formed by parts of the supply loop 107 that are substantially orthogonal to the ground plane 101. In these regions Z1, Z2 of excitation, the currents must be in phase, that is to say oriented in the same direction notably substantially parallel to the axis Z, and these currents are of close amplitudes, when the antenna 100 is supplied by the radiofrequency transmitter 200 or by the signal that it picks up. Thus, the supply loop 107 is notably configured such that it has, in the operation of the antenna 100 (that is to say when the antenna 100 emits or picks up a signal), two regions Z1, Z2 of excitation of the antenna 100 in which the currents are in phase and circulate substantially orthogonally with respect to the ground plane 101.

"Longitudinal ends 108, 109 of the supply loop 107" (FIGS. 2 to 6) is understood to mean that, lengthwise, this supply loop 107 comprises two opposing ends. These opposing longitudinal ends 108, 109 of the supply loop 107 are situated at a distance from one another, notably at an appropriate distance to allow the connection of the supply loop 107 to the transmitter 200 either directly or via a differential waveguide.

In this paragraph, an ample of narrowband monopole wire-plate antenna as illustrated in FIGS. 2 and 3 is described. "Narrowband" is understood to mean an operating band of the order of a few percent with respect to the centre frequency. This antenna 100 comprises the roof 102 having a square profile, taken in a plane parallel to the plane XY, measuring 7 mm by 7 mm. This roof 102 is situated at 3 mm from the ground plane 101, notably considered as infinite. Here, the supply loop 107 takes the form of a strip, and the profile of this supply loop 107 seen parallel to the plane XZ adopts the general form of a rectangle; the supply loop 107 therefore comprises four successive parts delimiting its outline. For example, the supply loop 107 has the following dimensions:

according to the axis Z, a dimension of 2.5 mm, according to the axis X, a dimension of 5.1 mm, the length, also called perimeter, of the supply loop 107 is 15.2 mm, notwithstanding the separation distance between the two longitudinal ends 108, 109 that is consider negligible, the width of the supply loop 107, measured according to the axis Y, can be 1.2 mm, the thickness of the supply loop 107 has no influence as long as it remains within conventional technological values ranging from ten or so to a few hundreds of micrometres.

Moreover, two electrically conductive elements 103*a*, 103*b* are formed by parallel wires, of 0.25 mm diameter, electrically linking the roof 102 to the ground plane 101. Notably, the longitudinal axes of the two electrically conductive elements 103*a*, 103*b* are separated from one another by 2 mm, and are disposed on either side of an axis substantially orthogonal to the plane of the roof 102 and passing through the centre of the roof 102. Such an antenna 100 has, when it is supplied differentially by a discrete 50 Ohms port, 3% of bandwidth at −10 dB (decibels) around 5.5 GHz. The matching of such an antenna 100 to 50 Ohms shows similar performance with respect to an antenna supplied asymmetrically by coaxial supply probe. Moreover, when the antenna operates at the frequency for which it is impedance-matched, the radiation efficiency of the antenna 100 is strictly greater than 95%, its gain pattern clearly indicates a radiation of monopolar type, and the maximum gain achieved is approximately 4.5 dBi.

The present paragraph describes an example of wideband monopole wire-plate antenna 100, for example as illustrated in FIGS. 4 and 5. "Wideband" is understood to mean an operating band strictly greater than the octave. The roof 102 has a profile, seen according to a plane parallel to the plane XY, of square form measuring 9.5 mm by 9.5 mm situated at 4 mm from the ground plane 101 considered as infinite. Here, the supply loop 107 takes the form of a strip and the profile of this supply loop 107 taken in a plane parallel to the plane XZ adopts the general form of a rectangle: the supply loop 107 therefore comprises four successive parts delimiting its outline. For example, the supply loop 107 has the following dimensions;

according to the axis Z, a dimension of 3.75 mm, according to the axis X, a dimension of 5.5 mm, the length, also called perimeter, of the supply loop 107 is 18.5 mm, notwithstanding the separation distance between the two longitudinal ends 108, 109 which is considered negligible, the width of the supply loop 107, or width of the strip, can be 1.2 mm, the thickness of the supply loop 107 has no influence provided that it remains within conventional technological values ranging from ten or so to a few hundreds of micrometres.

Moreover, two electrically conductive elements 103*a*, 103*b*, formed by tongues 3 mm wide (measured according to the axis Y), electrically link the roof 102 to the ground plane 101. The thickness of these tongues has no influence provided that it remains within conventional technological values ranging from ten or so to a few hundreds of micrometres. Notably, the two electrically conductive elements 103*a*, 103*b* are in contact respectively with two opposing peripheral edges of the bottom face (that is to say the face oriented towards the ground plane 101) of the roof 102, and are notably substantially orthogonal to the ground plane 101. Such an antenna 100 has a matching, normalized at 100 Ohms wideband, such that, when it is supplied differentially notably whether that be in emission or in reception, its bandwidth is 36% at −10 dB (decibel) around 7.7 GHz. At the operating frequency, here 7.7 GHz, and depending on the differential supply, the wideband antenna 100 has radiation efficiencies strictly greater than 90%, its gain pattern denotes a radiation of monopolar type, and the maximum gain achieved is close to 5 dBi, this being equivalent to the results obtained for a monopole wire-plate antenna supplied asymmetrically by coaxial supply probe.

It has been mentioned above that, for a good operation of the antenna 100, the currents which circulate in the supply loop 107, and in particular in parts of the supply loop 107 extending substantially orthogonally with respect to the ground plane 101, are in phase and preferably of close amplitudes when this antenna 100 emits or picks up a signal. To this end, the supply loop 107 advantageously comprises two parts substantially orthogonal to the ground plane 101: this allowing the supply loop 107 to exploit currents substantially orthogonal to the ground plane 101 and in phase to excite the antenna 100 appropriately in its operation. Preferably, the supply loop 107 comprises (see notably FIGS. 2 to 5) a first part 1071 distal to the ground plane 101, a second part 1072 proximal to the ground plane 101, a third part 1073 linking the first and second parts 1071, 1072 (notably linking two longitudinal ends of the first and second parts 1071, 1072). Notably, the opposing longitudinal ends 108, 109 of the supply loop 107 are then arranged opposite the third part 1073, that is to say on a side of the supply loop 107 opposite the third part 1073. Such a supply loop 107 is most particularly suited to obtaining the in-phase vertical currents sought to suitably excite the electromagnetic field under the roof 102 of the antenna 100 and notably between the roof 102 and the ground plane 101 when the antenna 100 emits or picks up a signal. Notably, the first and second parts 1071, 1072 extend along their length substantially parallel to the ground plane 101, and the third part 1073 extends along its length substantially orthogonally with respect to the ground plane 101.

In particular, the supply loop 107 can comprise a fourth part 1074 (FIGS. 2 to 5) linked to at least one of the first and second parts 1071, 1072, this fourth part 1074 being situated on the side of the supply loop 107 where its longitudinal ends 108, 109 are arranged. The first, third, second and fourth parts 1071, 1073, 1072, 1074 are arranged successively so as to delimit the outline of the supply loop 107. Thus, the currents substantially orthogonal to the ground plane 101 above-mentioned circulate notably in the third and fourth parts 1073, 1074. Notably, the fourth part 1074 is, particularly along its length, substantially orthogonal to the ground plane 101. The arrangement of the opposing longitudinal ends 108, 109 of the supply loop 107 opposite its third part 1073 makes it possible to promote, in the operation of the antenna 100, the obtaining of currents circulating in phase according to the axis Z, that is to say in the third and fourth parts 1073, 1074 substantially orthogonal to the ground plane 101.

The positioning of the longitudinal ends 108, 109 of the supply loop 107 at any point opposite the third part 1073 of the supply loop 107 (FIGS. 2 to 5 and 7 to 8) makes it possible to obtain the in-phase currents that are sought and that are substantially orthogonal to the ground plane 101. According to a first case, the supply loop 107 can be such that it comprises the fourth part 1074 comprising a first portion 1074*a* extending from the first part 1071 of the supply loop 107 notably towards the second part 1072 of the supply loop 107. According to this first case, the first portion 1074*a* comprises one of the longitudinal ends 108 of the supply loop 107. According to this first case, the fourth part 1074 of the supply loop 107 comprises a second portion 1074*b* extending from the second part 1072 of the supply loop 107 notably towards the first part 1071 of the supply loop 107, this second portion 1074*b* comprising the other of the longitudinal ends 109 of the supply loop 107 (FIGS. 2 to 5). According to the first case, the first and second portions 1074*a*, 1074*b* can have identical dimensions such that the excitation of the supply loop 107 by the transmitter 200 can be done in the middle of the fourth part 1074, or alternatively, different dimensions. When, in the first case, the excitation by the transmitter 200 is done in the middle of the fourth part 1074, the supply loop 107 has a horizontal symmetry favouring the balance of the currents over all the perimeter of the supply loop 107 and therefore in the third and fourth parts 1073, 1074 substantially orthogonal to the ground plane 101, this being advantageous for a good operation of the antenna 100. According to a second case illustrated in FIG. 7, the fourth part 1074 extends from the first part 1071 of the supply loop 107 notably towards the second part 1072 of the supply loop 107, and the fourth part 1074 comprises one of the longitudinal ends 108 of the supply loop 107. According to this second case, the second part 1072 of the supply loop 107 comprises the other of the longitudinal ends 109 of the supply loop 107. According to a third case illustrated in FIG. 8, the fourth part 1074 extends from the second part 1072 notably towards the first part 1071, and the fourth part 1074 comprises one of the longitudinal ends 109 of the supply loop 107. According to this third case, the first part 1071 comprises the other of the longitudinal ends 108 of the supply loop 107. The second and third cases are functional alternatives to the first case which is preferred. In these different cases, there are two of these regions Z1, Z2 of excitation of the antenna 100 and they are advantageously formed by the third and fourth parts 1073, 1074.

The roof 102 is notably a so-called "capacitive" roof considered to be small with respect to the operating wavelength of the antenna 100, that is to say that the dimensions of the roof 102 are notably strictly less than $\lambda_g/4$.

Depending on the degree of integration of the radiofrequency device the radiofrequency transmitter 200 can be linked directly to the supply loop 107, or can be linked to the supply loop via a balanced waveguide 110, also called differential waveguide. This balanced waveguide 110 belongs to the antenna 100. In FIG. 6, the waveguide 110 is represented comprising first and second electrical conductors 111, 112, for example adopting the form of electrically conductive tracks. The first electrical conductor 111 is connected to one of the longitudinal ends 108 of the supply loop 107 and the second electrical conductor 112 is connected to the other of the longitudinal ends 109 of the supply loop 107. The waveguide is to be "balanced" because it allows, by virtue of its electrical conductors 111, 112, if appropriate, the propagation of the supply electromagnetic wave of the supply loop 107 generated by the radiofrequency transmitter 200 to the supply loop 107 or the propagation of the electromagnetic wave picked up (that is to say the signal picked up) by the antenna 100 from the supply loop 107 to the radiofrequency transmitter 200. This offers the advantage of being able to adapt the distance between the antenna 100 and the radiofrequency transmitter 200. These first and second electrical conductors 111, 112 make it possible to respectively propagate two signals of equal amplitude and in phase opposition, resulting, if appropriate, in the propagation of the supply electromagnetic wave of the antenna 100 coming from the radiofrequency transmitter 200 or of the electromagnetic wave picked by the antenna 100. In the context of the radiofrequency device 1000, the first electrical conductor 111 is also connected to the first connection terminal 201, and the second electrical conductor 112 is also connected to the second connection terminal 202. The balanced waveguide 110 adopts a symmetrical geometry to ensure appropriate propagation of the supply electromagnetic wave. The balanced waveguide 110 can adopt the form of coplanar microstrip lines, twin lines, or a two-wire line.

Obviously, the waveguide 110 is not necessary if the supply loop 107 can be directly linked to the radiofrequency transmitter 200. In this sense, more generally, the two opposing longitudinal ends 108, 109 of the supply loop 107 can be linked to a differential connection of a differential waveguiding device, this differential device possibly being the balanced waveguide 110 or the connection terminals 201, 202 of the radiofrequency transmitter 200.

Figure 9:
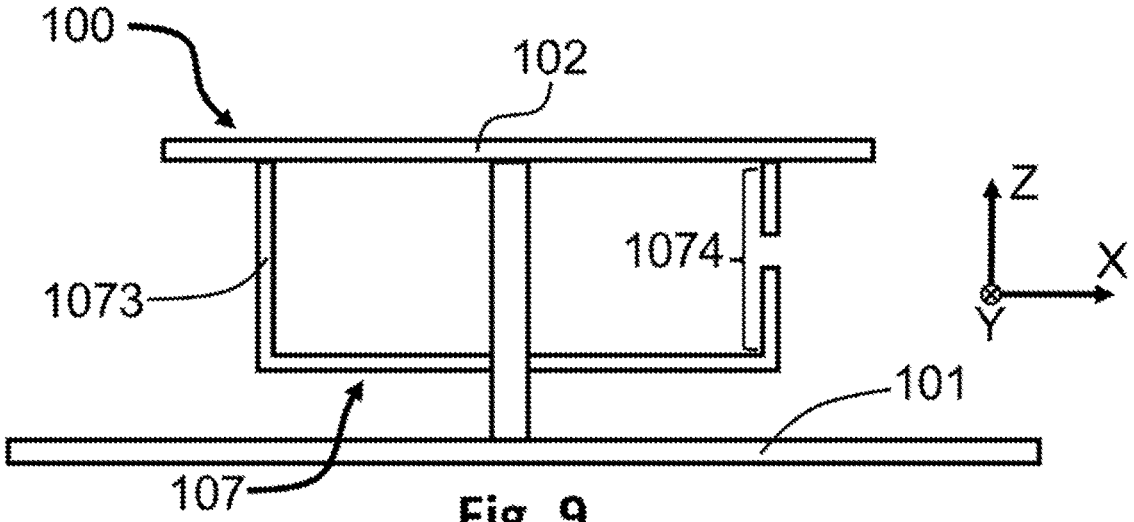
FIG. 9 illustrates a side view of a particular embodiment of a monopole wire-plate antenna of the type of FIG. 2.
Figure 10:
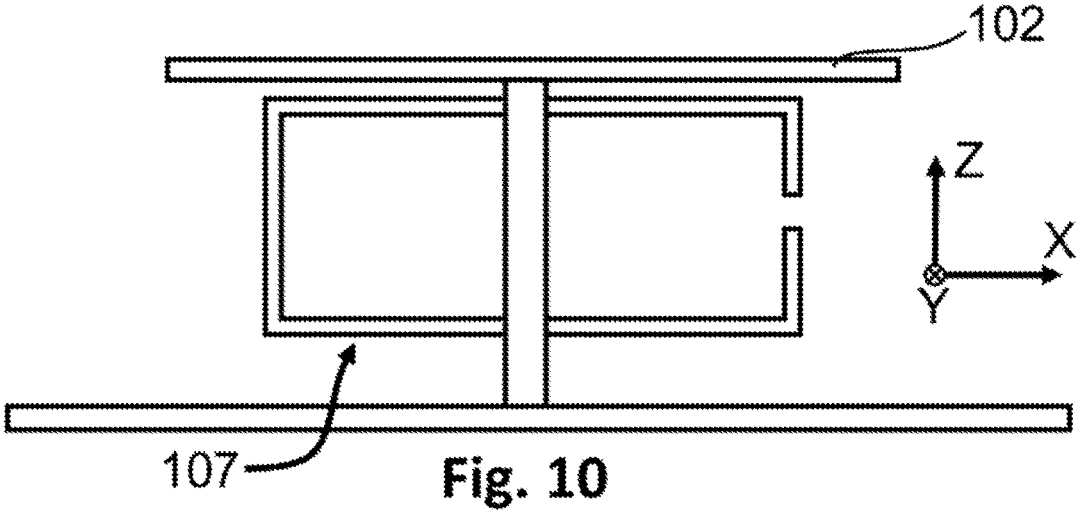
FIG. 10 illustrates a side view of a particular embodiment of a monopole wire-plate antenna of the type of FIG. 2.
Figure 11:
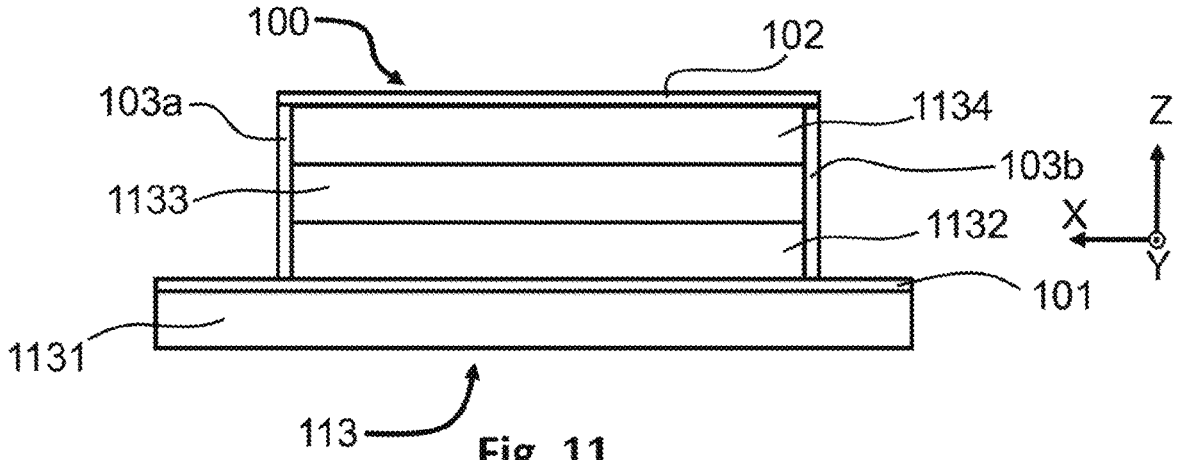
FIG. 11 illustrates a side view of a wideband monopole wire-plate antenna comprising a multilayer support substrate.

In a way that is applicable to all the embodiments described, a part of the supply loop 107 can be formed by a portion of the roof 102, this is notably illustrated in FIG. 9 in which the third and fourth parts 1073, 1074 are in contact directly with the roof 102 which delimits the first part of the supply loop 107. Alternatively, the supply loop 107 can be in contact with the roof 102 (FIGS. 3, 5, 7 and 8) or can be situated at a distance from the roof 102 (FIG. 10). The fact that a part, notably the first part 1071 described hereinabove, is formed by a portion of the roof 102, or is in contact with the roof 102, makes it possible to limit the size of the antenna 100 according to the axis Z, for example by reducing the separation distance between the roof 102 and the ground plane 101. An additional advantage of the supply loop 107 of which a part is delimited by the roof 102 is that that reduces the complexity of the antenna 100 manufacturing method since there will be one less level of metallization to be deposited.

The perimeter, also called length, of the supply loop 107 has an impact on the impedance matching of the antenna 100.

To study the impact of the length of the supply loop 107 in the context of the example of the narrowband antenna (FIGS. 2 and 3) for which the impedance matching is normalized at 50 Ohms, it is proposed to set the dimensions of the supply loop 107 according to the axis X (that is to say the length of the first part 1071 and the length of the second part 1072) to 5 mm for different study cases for which the length of the supply loop 107, also called perimeter denoted P of the supply loop 107, is respectively set at 14 mm, at 14.5 mm and at 15 mm: the result thereof is that the height of the supply loop 107 according to the axis Z is respectively 2 mm, 2.25 mm and 2.5 mm for these different study cases. The setting of the dimensions of the supply loop 107 according to the axis X at 5 mm makes it possible to separate the zones of excitation Z1 and Z2 by one and the same distance for the different study cases. According to the different narrowband antenna study cases, the opposing longitudinal ends 108, 109 of the supply loop 107 are situated equidistance, for example at 0.25 mm, from the middle of the fourth part 1074 described hereinabove according to the axis Z. By analysing the input impedance (real and imaginary part) of the antenna 100 for these three study cases, it is possible to deduce therefrom that the increasing of the perimeter P of the supply loop 107 causes an offsetting of the resonance towards the low frequencies. Consequently, by analysing the reflection coefficient (dB) of the antenna 100 as a function of the frequency, normalized at 50Ω, for these three antenna 100 study cases, it is possible to note that the operating frequency of the antenna 100 for which the best impedance matching of the antenna 100 is obtained decreases with the increasing of the perimeter P of the supply loop 107. Thus, in the present case, the matching of the antenna 100 occurs since the perimeter of the loop is of optimal dimension close to $\lambda_0/3.6$, where $\lambda_0$ is the operating wavelength of the antenna 100. With the elongation of the supply loop 107, the phasing of the currents in the regions Z1, Z2 of excitation can thus occur at lower frequencies. Moreover, the balance of the regions Z1, Z2 of excitation in amplitude and in phase on the current density is lost at the frequency of interest when the perimeter P is too small or too great with respect to this optimal perimeter dimension de $\lambda_0/3.6$ of the supply loop 107. Thus, to obtain a good impedance matching of the antenna 100, when the antenna is a narrowband antenna 100, the supply loop 107 preferentially has a length, between its two opposing longitudinal ends 108, 109, of between $\lambda_g/3.5$ and $\lambda_g/3.7$ with $\lambda_g$ the operating wavelength of the antenna 100 in the propagation medium of the antenna 100. The propagation medium of the antenna 100 is the medium in contact with each radiating element of the antenna 100, for example the medium in contact with each electrically conductive element 103*a*, 103*b*. This propagation medium can be air or a dielectric material.

To study the impact of the length of the supply loop 107 on the wideband antenna 100 (FIGS. 4 and 5) for which the impedance-matching is normalized at 100 Ohms, it is proposed to set the dimensions, notably the length, of the first and second parts 1071, 1072 of the supply loop 107 according to the axis X, each at 5.5 mm. The setting of the dimensions of the supply loop 107 according to the axis X at 5.5 mm makes it possible to separate the zones of excitation Z1 and Z2 by one and the same distance for the different study cases. Then, the different study cases are such that the length of the supply loop 107 varies between 16.5 mm and 18.5 mm according to a pitch of 0.5 mm, that is to say five study cases with P respectively equal to 16.5 mm, 17 mm, 17.5 mm, 18 mm and 18.5 mm. The result thereof is that the height of the supply loop 107 cording to the axis Z for these different study cases is respectively 2.75 mm, 3 mm, 3.25 mm, 3.5 mm, 3.75 mm. By analysing the input impedance (real and imaginary part of the input impedance of the antenna 100 in Ohms as a function of the frequency of the antenna 100) of the antenna 100 for these five study cases, it is possible to deduce therefrom that the increasing of the perimeter of the supply loop 107 causes an offsetting of the resonance towards the low frequencies. Consequently, the frequency having the best impedance-matching of the antenna 100, normalized at 100Ω, decreases with the increasing of the perimeter of the supply loop 107. Thus, the matching of the antenna 100 occurs since the perimeter of the supply loop 107 is of optimal dimension close to $\lambda_0/2$, where $\lambda_0$ is the operating wavelength of the antenna 100 when the propagation medium of the antenna is air. Moreover, the balance of the excitation of the antenna 100, in the regions Z1, Z2 of excitation, in amplitude and in phase on the current density is lost when the supply loop 107 has a perimeter that is too great or too small with respect to its optimal dimension. Thus, at 6.5 GHz, for the antenna 100 having a loop of perimeter P equal to 16.5 mm, the currents in the regions Z1, Z2 of excitation of the antenna 100 are phase-shifted. On the other hand, at this same frequency and with a supply loop 107 of greater perimeter (for example with P equal to 18.5 mm), the currents are in phase and of the same amplitude in the regions Z1, Z2 of excitation of the antenna 100. For the antenna 100 having a supply loop 107 of perimeter P equal to 16.5 mm and with the increasing of the operating frequency of the antenna 100, it is observed that the phasing of the currents is improved in the regions Z1, Z2 of excitation. On the other hand, for the antenna 100 comprising a supply loop 107 of perimeter P equal to 18.5 mm, the balance of the regions Z1, Z2 of excitation of the antenna 100 is lost in amplitude and in phase on the current density with the increasing of the frequency. Thus, to obtain a good impedance-matching of the antenna 100, when said antenna 100 is a wide-bandwidth antenna, the supply loop 107 preferentially has a length, between its two opposing longitudinal ends 108, 109, of between $\lambda_g/3$ and $\lambda_b/1.6$ with $\lambda_g$ the operating wavelength of the antenna 100 notably in the propagation medium of the antenna 100.

The width of the supply loop 107, notably measured according to the axis Y, can also be adapted as a function of the characteristics that are sought for the antenna 100.

For example, for the narrowband antenna 100 described, by setting the length of the supply loop 107 at 15 mm while varying its width between 0.8 mm and 1.4 mm according to a pitch of 0.2 mm, it has been noted that increasing the width of the supply loop 107 leads to matching of the antenna 100 for lower operating frequencies. That is synonymous with an elongation of the loop equivalent to the supply loop 107 linked to the increasing of its width.

For example, for the wideband antenna 100, by setting the length of the supply loop 107 at 18.5 mm while varying its width between 0.5 mm and 2 mm according to a pitch of 0.5 mm, it has been noted that increasing the width of the supply loop 107 leads to a reduction of the real part of the input impedance associated with an increasing of the imaginary part of the input impedance around 8 GHz. Thus, for the specific dimensions of the wideband monopole wire-plate antenna 100, a width of the supply loop 107 of approximately 0.5 mm is optimal for a good matching (strictly less than −10 dB) according to a normalization impedance of 100 ohms for an operating frequency of the antenna of between 6.3 GHz and 9 GHz.

Figure 12:
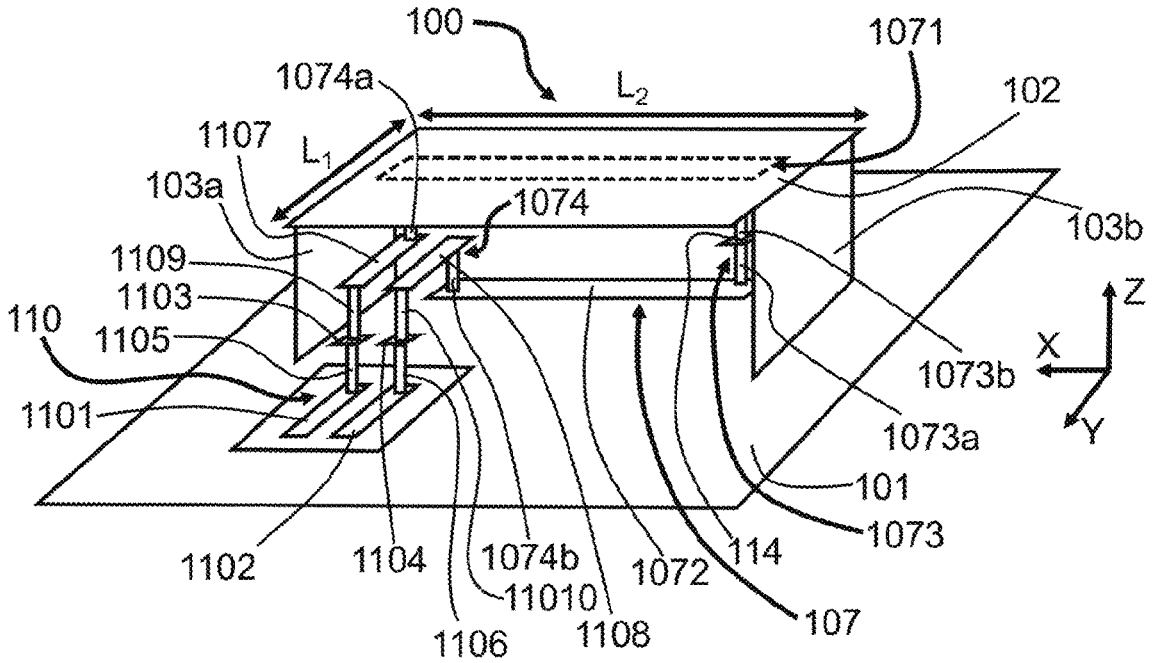
FIG. 12 illustrates a perspective view of FIG. 11 for which the multilayer support substrate has been removed.

A particular example (illustrated in FIGS. 11 and 12) is now described for which the antenna 100 comprises a multilayer dielectric substrate 113, notably with four layers of dielectric material, within which there is formed an electrically conductive structure comprising the ground plane 101, the roof 102, the supply loop 107, the electrically conductive elements 103*a*, 103*b* and the balanced waveguide 110. Here, the dielectric material of the layers of the substrate 113 forms the propagation medium of the antenna 100. A portion of the roof 102 forms the first part 1071 (represented in dotted lines in FIG. 12) of the supply loop 107. According to this particular example, the substrate 113 comprises a stack of first to fourth layers 1131, 1132, 1133, 1134 of dielectric material. FIG. 12 represents a perspective of the FIG. 11 for which the first to fourth layers have been removed to view the electrically conductive structure (comprising the elements referenced 101, 102, 103*a*, 103*b*, 107, 110). On the first layer 1131, there are arranged the ground plane 101 and two tracks 1101, 1102 forming first and second portions of the balanced waveguide 110. The second layer 1132 is stacked on the first layer 1131. On a face of this second layer 1132 oriented opposite the first layer 1131, there are formed the second part 1072 of the supply loop 107 and first and second pads 1103, 1104 forming corresponding portions of the balanced waveguide 110. This second layer 1132 is passed through by a third portion 1105 of the waveguide 110 in contact, on the one hand, with the first portion 1101 of the waveguide 110 and, on the other hand, with the first pad 1103. Moreover, this second layer 1132 is passed through by a fourth portion 1106 of the waveguide 110, this fourth portion 1106 being in contact, on the one hand, with the second portion 1102 of the waveguide 110 and, on the other hand, with the second pad 1104. The third layer 1133 is stacked on the second layer 1132. On this third layer 1133, there are formed an electrically conductive terminal 114, as well as fifth and sixth portions 1107, 1108 of the balanced waveguide 110 adopting the form of electrically conductive tracks parallel to the ground plane 101. This third layer 1133 is passed through by seventh and eighth portions 1109, 11010 of the waveguide 110, the seventh portion 1109 electrically linking the fifth portion 1107 to the first pad 1103, and the eighth portion 11010 linking the sixth portion 1108 to the second pad 1104. This third layer 1133 is also passed through by a first portion 1073*a* of the third part 1073 of the supply loop 107, this first portion 1073*a* linking the second part 1072 of the supply loop 107 to the terminal 114. This third layer 1133 is also passed through by the second portion 1074*b* of the fourth part 1074 of the supply loop 107, this second portion 1074*b* linking the second part 1072 of the supply loop 107 to the sixth portion 1108 of the waveguide 110. The fourth layer 1134 is stacked on the third layer 1133. The roof 102, and therefore the first part 1071 of the supply loop 107, are arranged on a face of this fourth layer 1134 oriented toward a direction opposite the third layer 1133. This fourth layer 1134 is passed through by the first portion 1074*a* of the fourth part 1074 of the supply loop 107 such that the first portion 1074*a* of the fourth part 1074 links the fifth portion 1107 of the waveguide 110 to the portion of the roof 102 forming the first part 1071 of the supply loop 107. This fourth layer 1134 is also passed through by a second portion 1073*b* of the third part 1073 of the supply loop 107 such that the second portion 1073*b* of the third part 1073 links the portion of the roof 102 forming the first part 1071 of the supply loop 107 to the terminal 114. The stack of the second, third and fourth layers 1132, 1133, 1134 has two opposing metallized sides forming the electrically conductive elements 103*a*, 103*b* electrically linking the roof 102 to the ground plane 101. Notably, the first and second portions 1074*a*, 1074*b* of the fourth part 1074 of the supply loop 107, the first and second portions 1073*a*, 1073*b* of the third part 1073 of the supply loop 107, and the third, fourth, seventh and eighth portions 1105, 1106, 1109, 11010 of the waveguide 110 are vies (also called metallized holes) passing through the corresponding layers of the substrate 113. According to this particular example, the roof 102 of the antenna 100 is rectangular and has a first side of dimension $L_1$ equal to 8 mm and a second side of dimension $L_2$ equal to 11 mm. The roof 102 is printed on a dielectric substrate of relative permittivity $\varepsilon_r$=2.2 and of parameter tan δ=0.0009, tan δ characterizing the dielectric losses of the material of the dielectric substrate. Such a multilayer dielectric substrate can be of Rogers RT/duroid® 5880 type. The roof 102 is disposed at 4.8 mm from the infinite ground plane 101. The supply loop 107 supplying the antenna 100 has the following characteristics:

the geometric perimeter of the supply loop 107 is set at 21.4 mm for a rectangular supply loop 107 of sides 7.5 mm according to the axis X and 3.2 mm according to the axis Z (considering the dielectric in which the supply loop 107 is placed, the wavelength really guided is reduced 31 mm, for which it would also be necessary to take account of the effect of change of section of the roof 102 of the antenna 100, the wavelength of 37.5 mm at 8 GHz, which is the middle of the operating band, is approached);

the waveguide 110 is connected to the supply loop 107 at the centre of its fourth part 1074 according to the axis Z;

the width of the second part 1072 of the supply loop 107 according to the axis Y is set at 2 mm;

the metallized holes mentioned above have a diameter, according to the axis Y, equal to 0.2 mm.

Figure 13:
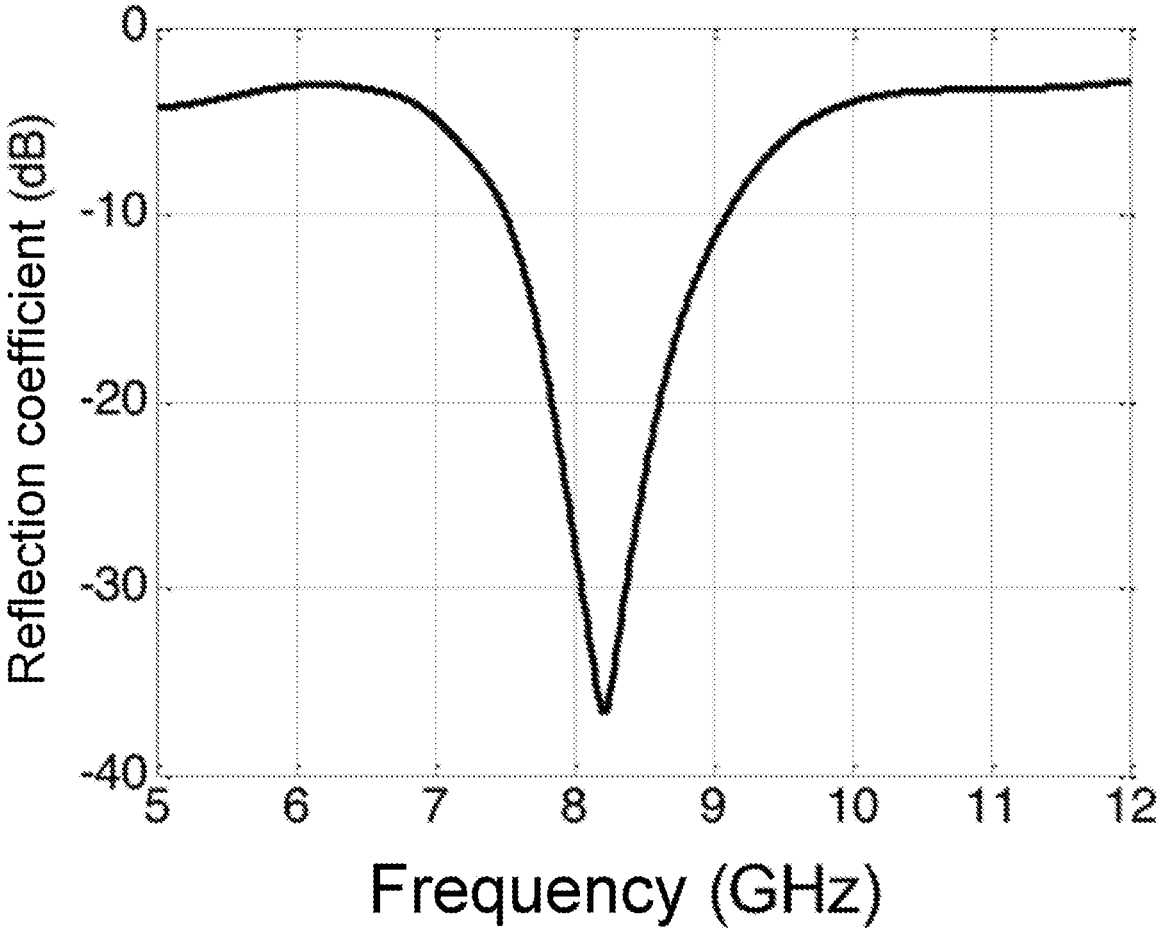
FIG. 13 illustrates the variation of the reflection coefficient in dB of the antenna of FIG. 12 as a function of the frequency of the antenna in GHz.
Figure 14:
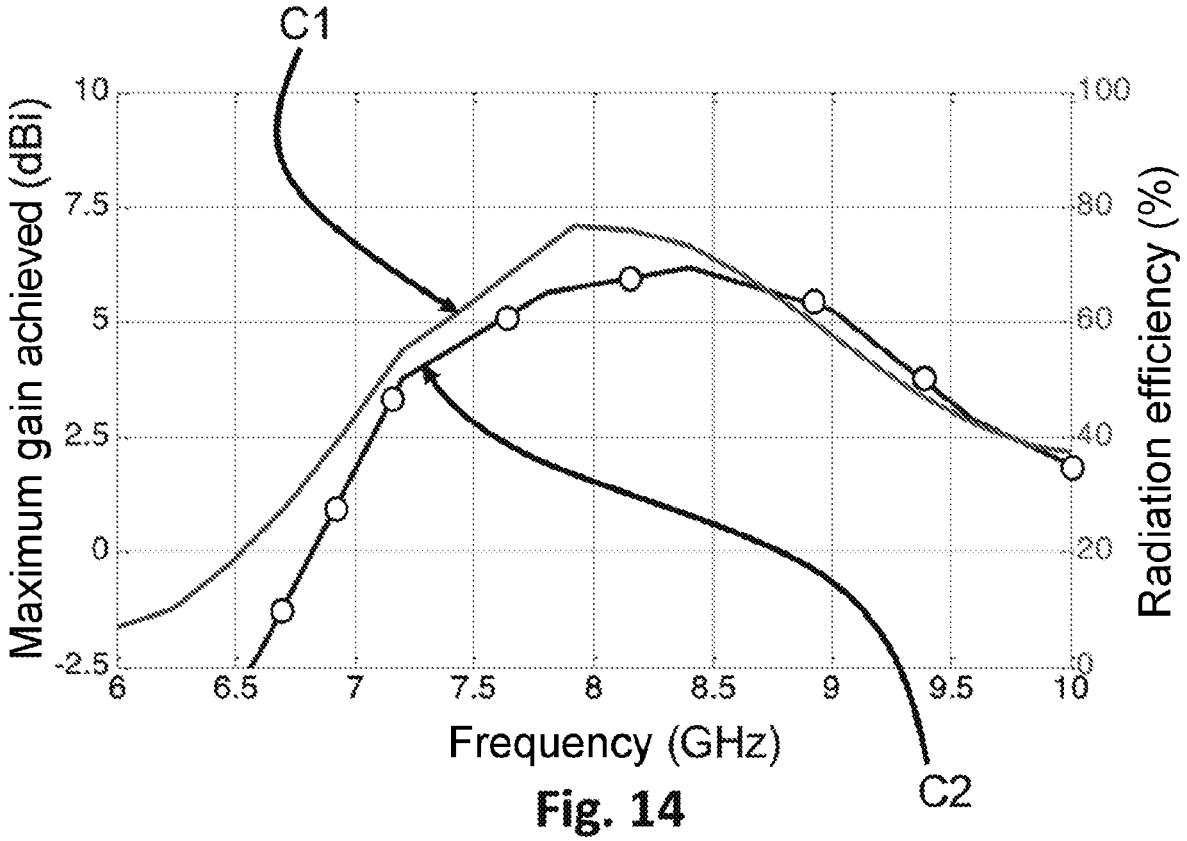
FIG. 14 shows a curve C2 of the variation of the maximum gain obtained of the antenna of FIG. 12 in dBi as a function of the frequency of the antenna in GHz, and a curve C1 of the variation of the radiation efficiency in percentage terms of the antenna of FIG. 12 as a function of the frequency of the antenna in GHz.

The first and second portions 1101, 1102 of the waveguide 110 form differential coplanar lines printed for example on a zone of the first layer 1131 not covered by the ground plane 101. Moreover, it is possible to envisage using this antenna 100 supplied differentially via the supply loop 107 for an integration above a chip package (for example QFN for Quad-Flat No-leads). FIG. 13 presents, for this particular example, the variation of the reflection coefficient of the antenna 100 in dB as a function of the frequency of the antenna in GHz normalized on 100 Ohms, this FIG. 13 shows a satisfactory impedance matching ($S_{11}$ a strictly less than −10 dB with $S_{11}$ the reflection coefficient of the antenna 100) between 7.5 GHz and 9.2 GHz. FIG. 14 represents on abscissa the frequency of the antenna in GHz, the ordinate axis on the left gives, for the curve C2, the maximum gain achieved in dBi as a function of the frequency of the antenna 100, and the ordinate axis on the left gives, for the curve C1, the radiation efficiency of the antenna 100 in percentage terms as a function of the frequency of the antenna 100. FIG. 14 makes it possible to plot the reflection coefficient as a function of the frequency to identify the point where the reflection coefficient is low, synonymous with impedance matching of the antenna 100 and identification of the operating frequency. It can be observed from this FIG. 14 that, in the target frequency band of between 7.5 GHz and 9.2 GHz, the efficiency is satisfactory and the maximum gain of the antenna 100 is of between 4 dBi and 6 dBi. The present invention therefore makes it possible to construct a monopole wire-plate antenna that can be supplied directly by a differential waveguide, that is to say (without balun) with satisfactory performance. Moreover, by removing the balun, the losses linked to this balun are avoided. Moreover, the monopole wire-plate antenna with supply loop 107 as described offers performance similar to that of a monopole wire-plate antenna supplied asymmetrically by coaxial probe.

Such a monopole wire-plate antenna is industrially applicable in the field of telecommunications in which such an antenna can be manufactured and arranged in a radiofrequency device as described above. The radiofrequency device described can be integrated in any type of communicating object. For example, the radiofrequency device can be incorporated in a smartphone worn on the belt of a person to transmit via the antenna 100 a video stream to interactive goggles by using an ultra-wideband link of between 7 GHz and 9 GHz.

The invention claimed is:

1. A monopole wire-plate antenna comprising:

a ground plane, a roof arranged at a distance from the ground plane, at least one electrically conductive element electrically linking the ground plane to the roof, and a supply loop arranged substantially orthogonally with respect to the ground plane, said supply loop having:

a first part comprising a first plate arranged distal to and substantially parallel to the ground plane, and a second part extending substantially orthogonally to the first part, being connected to the first part and having an opening such that the second part comprises two opposing longitudinal ends arranged so as to be linked to a differential connection.

2. The antenna according to claim 1, comprising a balanced waveguide, the balanced waveguide comprising a first electrical conductor and a second electrical conductor, the first electrical conductor being connected to one of the longitudinal ends of the supply loop and the second electrical conductor being connected to the other of the longitudinal ends of the supply loop.

3. A monopole wire-plate antenna, comprising:

a ground plane, a roof arranged at a distance from the ground plane, at least one electrically conductive element electrically linking the ground plane to the roof, and a supply loop arranged substantially orthogonally with respect to the ground plane, said supply loop being open such that it comprises two opposing longitudinal ends arranged so as to be linked to a differential connection, wherein the supply loop comprises:

a first part distal to the ground plane, a second part proximal to the ground plane, and a third part linking the first and second parts, the longitudinal ends being arranged opposite the third part.

4. The antenna according to claim 3, wherein the supply loop comprises:

a fourth part comprising:

a first portion extending from the first part of the supply loop, the first portion comprising one of the longitudinal ends of the supply loop, and a second portion extending from the second part of the supply loop, the second portion comprising the other of the longitudinal ends of the supply loop, or a fifth part extending from the first part and comprising one of the longitudinal ends of the supply loop, the second part comprising the other of the longitudinal ends of the supply loop, or a sixth part extending from the second part and comprising one of the longitudinal ends of the supply loop, the first part comprising the other of the longitudinal ends of the supply loop.

5. The antenna according to claim 1, wherein:

a part of the supply loop is formed by a portion of the roof, or the supply loop is situated at a distance from the roof, or the supply loop is in contact with the roof.

6. The antenna according to claim 1, wherein said supply loop has, in the operation of the antenna, two regions of excitation of the antenna in which currents are in phase and circulate substantially orthogonally with respect to the ground plane.

7. A monopole wire-plate antenna comprising:

a ground plane, a roof arranged at a distance from the ground plane, at least one electrically conductive element electrically linking the ground plane to the roof, and a supply loop arranged substantially orthogonally with respect to the ground plane, said supply loop being open such that it comprises two opposing longitudinal ends arranged so as to be linked to a differential connection, wherein said antenna is one of:

a wide-bandwidth antenna for which the supply loop has a length, between the two opposing longitudinal ends, of between $\lambda_g/3$ and $\lambda_g/1.6$ with $\lambda_g$ being an operating wavelength of the antenna, and a narrowband antenna for which the supply loop has a length, between the two opposing longitudinal ends, of between $\lambda g/3.5$ and $\lambda_g/3.7$.

8. A radiofrequency device comprising a monopole wire-plate antenna according to claim 1, and a radiofrequency transmitter with a differential connection linked to the supply loop.

9. The radiofrequency device according to claim 8, wherein:

the differential connection of the radiofrequency transmitter comprises first and second connection terminals, the antenna comprises a balanced waveguide, the balanced waveguide comprising first and second electrical conductors, the first electrical conductor is connected to one of the longitudinal ends of the supply loop and to the first connection terminal, and the second electrical conductor is connected to the other of the longitudinal ends of the supply loop and to the second connection terminal.

10. The antenna according to claim 1, wherein the loop comprises:

a third part extending substantially parallel to the ground plane, and a fourth part extending substantially orthogonally to the first part and physically connecting the first and third parts.

11. The antenna according to claim 10, wherein the third part comprises one of:

a portion of the roof, a plate situated at a distance from the roof, and a plate in contact with the roof.

12. The antenna according to claim 10, wherein the second part is physically connected to the first part and the third part.

13. The antenna according to claim 1, wherein said antenna is one of:

a wide-bandwidth antenna for which the supply loop has a length, between the two opposing longitudinal ends, of between $\lambda_g/3$ and $\lambda_g/1.6$ with $\lambda_g$ being an operating wavelength of the antenna, and a narrowband antenna for which the supply loop has a length, between the two opposing longitudinal ends, of between $\lambda_g/3.5$ and $\lambda_g/3.7$.

14. The antenna according to claim 3, wherein the first part comprises a plate arranged substantially parallel to the ground plane.

15. The antenna according to claim 3, wherein said antenna is one of:

a wide-bandwidth antenna for which the supply loop has a length, between the two opposing longitudinal ends, of between $\lambda_g/3$ and $\lambda_g/1.6$ with $\lambda_g$ being an operating wavelength of the antenna, and a narrowband antenna for which the supply loop has a length, between the two opposing longitudinal ends, of between $\lambda_g/3.5$ and $\lambda_g/3.7$.

* * * * *